US010569112B2

(12) United States Patent
Lambridis

(10) Patent No.: US 10,569,112 B2
(45) Date of Patent: Feb. 25, 2020

(54) FIRE AND/OR SMOKE BLOCKING DEVICE

(71) Applicant: Andrew C. Lambridis, Dix Hills, NY (US)

(72) Inventor: Andrew C. Lambridis, Dix Hills, NY (US)

(73) Assignee: McKeon Rolling Steel Door Company, Inc., Bellport, NY (US)

( * ) Notice: Subject to any disclaimer, the term of this patent is extended or adjusted under 35 U.S.C. 154(b) by 16 days.

(21) Appl. No.: 15/262,251

(22) Filed: Sep. 12, 2016

(65) Prior Publication Data

US 2016/0375283 A1 Dec. 29, 2016

Related U.S. Application Data

(63) Continuation of application No. 12/214,877, filed on Jun. 23, 2008, now Pat. No. 9,440,100.

(Continued)

(51) Int. Cl.

| | |
|---|---|
| ***E06B 9/40*** | (2006.01) |
| ***A62C 2/10*** | (2006.01) |
| ***E06B 3/80*** | (2006.01) |
| ***E06B 9/13*** | (2006.01) |
| ***E06B 5/16*** | (2006.01) |
| *E06B 9/17* | (2006.01) |

(52) U.S. Cl.

CPC ..... *A62C 2/10* (2013.01); *E06B 3/80* (2013.01); *E06B 5/16* (2013.01); *E06B 9/13* (2013.01);

(Continued)

(58) Field of Classification Search

CPC ..... E06B 7/32; E06B 9/17; E06B 9/08; E06B 9/11; E06B 9/17046; E06B 9/54;

(Continued)

(56) References Cited

U.S. PATENT DOCUMENTS 3,583,465 A 6/1971 Youngs et al.
4,217,731 A 8/1980 Saino (Continued)

FOREIGN PATENT DOCUMENTS

JP 09253229 A * 9/1997 ..... A62C 2/10
JP 10-205246 8/1998

OTHER PUBLICATIONS

NFPA 80 Standard for Fire Doors and Other Opening Protectives 2010 Edition, p. 80-8, 80-9, 80-11, 80-12, 80-15, 80-16.

(Continued)

*Primary Examiner* — Katherine W Mitchell
*Assistant Examiner* — Jeremy C Ramsey
(74) *Attorney, Agent, or Firm* — Cozen O'Connor

(57) ABSTRACT

An assembly for covering an opening in a structure. The assembly has a roller to be mounted to a portion of the structure defining a portion of the structure opening and a member disposed on the roller assembly. The member is operable between a retracted position where it is wound onto the roller assembly and an extended position where it is unwound from the roller assembly. The member includes first and second portions with mutually opposing edges in a closed position. A fastener releasably attaches the first and second panel portions to each other. The first and second panel portions are separable in response to an egress force to form an egress through the member.

19 Claims, 8 Drawing Sheets

Related U.S. Application Data

(60) Provisional application No. 60/936,833, filed on Jun. 22, 2007.

(52) U.S. Cl.
CPC ..... *E06B 9/40* (2013.01); *E06B 2009/17053* (2013.01)

(58) Field of Classification Search
CPC ..... E06B 2009/2452; E06B 9/13; E06B 9/80; E06B 5/16; E06B 5/162; E06B 2009/17053; A47H 23/01; A47H 99/00; A62C 2/10
See application file for complete search history.

(56) References Cited

U.S. PATENT DOCUMENTS

| | | | | |
|---|---|---|---|---|
| 4,436,137 | A | 3/1984 | Charles | |
| 4,461,120 | A | 7/1984 | Hemmerling | |
| 4,874,028 | A | 10/1989 | Lynch et al. | |
| 5,524,689 | A | 6/1996 | Clark | |
| 5,577,541 | A | 11/1996 | McKeon | |
| 6,070,640 | A * | 6/2000 | Miyagawa | A62C 2/10 160/121.1 |
| 6,962,188 | B2 | 11/2005 | Coenraets | |
| 2003/0188837 | A1 * | 10/2003 | Varley | E06B 9/13 160/264 |
| 2006/0283562 | A1 | 12/2006 | Hickey | |

OTHER PUBLICATIONS

International Code Council, International Building Code 2012, p. 32, 86, 136, 246, 247.

NFPA 101 Life Safety Code, 2009 Edition, p. 101-34, 101-48, 101-49, 101-52, 101-54, 101-85, 101-89.

Smoke Guard; accessed from http://web.archive.org/web/20070024171253/http://www.smokeguard.com/Models/faq.asp on Sep. 10, 2014; published on Feb. 27, 2007.

BLE Smoke and Fire Curtains; accessed from http://www.ble-smokeandfirecurtains.com on Sep. 10, 2014.

* cited by examiner

FIRE AND/OR SMOKE BLOCKING DEVICE

CROSS REFERENCE TO RELATED APPLICATIONS

This application is a continuation of U.S. patent application Ser. No. 12/214,877 which was filed with the U.S. Patent and Trademark Office on Jun. 23, 2008. Priority is claimed for this invention and application, from U.S. Provisional Patent Application Ser. No. 60/936,833 which was filed on Jun. 22, 2007.

BACKGROUND OF THE INVENTION

1. Field of the Invention

The present invention relates generally to a fire and/or smoke blocking device for selectively covering an opening in a wall, and particularly to a fire door assembly with an egress for allowing passage therethrough when the wall opening is covered by the fire door assembly.

2. Description of the Related Art

A "labeled" door assembly is defined by the National Fire Protection Association as a combination of a door, hardware and other accessories which together provide a specific degree of protection to an opening when closed and to which has been attached a label or other identifying mark to indicate compliance with nationally recognized standards or tests. Conversely, all other door assemblies are referred to as "non-labeled" door assemblies.

For emergency egress purposes, various building codes and the like require any building having either a slide-type or rolling type door assembly to include both a fire door positionable to close an opening and a hinged-type wicket or pass door for passage therethrough when the opening is closed by the fire door. In some cases, compliance with the above requirement may be achieved merely by providing the pass door in the wall of the building adjacent the fire door. Alternatively, a pass door may be incorporated into the movable fire door itself. In U.S. Pat. Nos. 4,217,731 and 4,461,120, for example, there are shown fire door assemblies which include a single hinged pass door in a sliding fire door for allowing passage through the sliding fire door. As will be readily appreciated, however, sliding fire doors may be unattractive to building designers because of the need to provide adjacent wall space to accommodate them. This same need for adjacent space may also complicate or frustrate efforts to retrofit a sliding door over an existing opening.

In an effort to avoid the space problems and other disadvantages associated with slide-type door assemblies, rolling door assemblies, which include a shutter curtain that is raised or lowered from a roller positioned above the opening, have been developed. Typically, two vertically disposed channels are positioned adjacent opposite lateral sides of the opening to guide the shutter curtain as it is retracted or extended between the opened and closed positions.

While a service door configuration is known in which a pass door frame is hingedly connected to a vertical, shutter guide channel to provide passage when the rolling curtain service door is closed, this configuration utilizes a door frame structure that must be manually positioned and locked prior to extension of the shutter curtain. As such, this configuration can not be utilized in self-closing fire door applications in which the rolling door is closed automatically, such, for example, in response to detection of a fire.

U.S. Pat. No. 5,577,541 discloses a rolling door assembly having a pass door arrangement, which is positioned inside a structure opening and fixed to the structure. A vertical edge of the pass door frame serves as a channel in which an edge of the narrow section of a sliding or rolling door panel or curtain is guided as the curtain moves to its closed position. During lowering of the curtain, an alignment member or "floating bar" rests on the top of the already-closed pass door frame. According to this arrangement, the pass door frame and door arrangement must be attached to the structure and remain in the structure opening under a non-emergency situation.

SUMMARY OF THE INVENTION

The embodiments described below relate to a fire and/or smoke blocking device, such as a fire door assembly, for covering a structure opening in a sidewall of a structure. The fire door assembly comprises a roller assembly to be mounted to a portion of the structure defining the structure opening. The fire door assembly may have a curtain panel disposed on the roller assembly and operable between a retracted position where the curtain panel is wound onto the roller assembly and an extended position where the curtain panel is unwound from the roller assembly to cover the structure opening.

The curtain panel includes first and second panel portions with mutually opposite edge portions that are releasably connectable in a closed position. A fastener is provided and operable to releasably secure the first and second panel portions to each other in a blocking condition. The first and second panel portions are separable from each other in response to an egress force exerted thereon, thereby forming an egress through the curtain panel. Upon relaxation or removal of the egress force, the first and second panel portions return to the closed position to close the egress. The mutually opposite edge portions at least partially overlap in a preferred embodiment of the invention.

According to another aspect of the invention, the fire door assembly may comprise a roller assembly to be mounted to a portion of the structure defining a portion of the structure opening and a movable flap disposed onto the roller assembly. The movable flap is operable between a retracted position where the movable flap is wound onto the roller assembly and an extended position where the movable flap is unwound from the roller assembly to cover at least a portion of the structure opening.

A first fastener is provided to be immovably mounted in relation to the structure in the extended position while a second fastener is fixed to the movable flap to releasably attach to the first fastener, thereby maintaining a blocking condition of the fire door assembly. The first and second fasteners can be selectively disengaged from each other in response to an egress force so that the moving flap can be separated from and moved away from the first fastener to form an egress therebetween. Upon relaxation or removal of the egress force, the movable flap is operable to return to the closed position to close the egress.

Other objects and features of the present invention will become apparent from the following detailed description considered in conjunction with the accompanying drawings, in which same or similar components and elements are designated with the same numeral reference. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
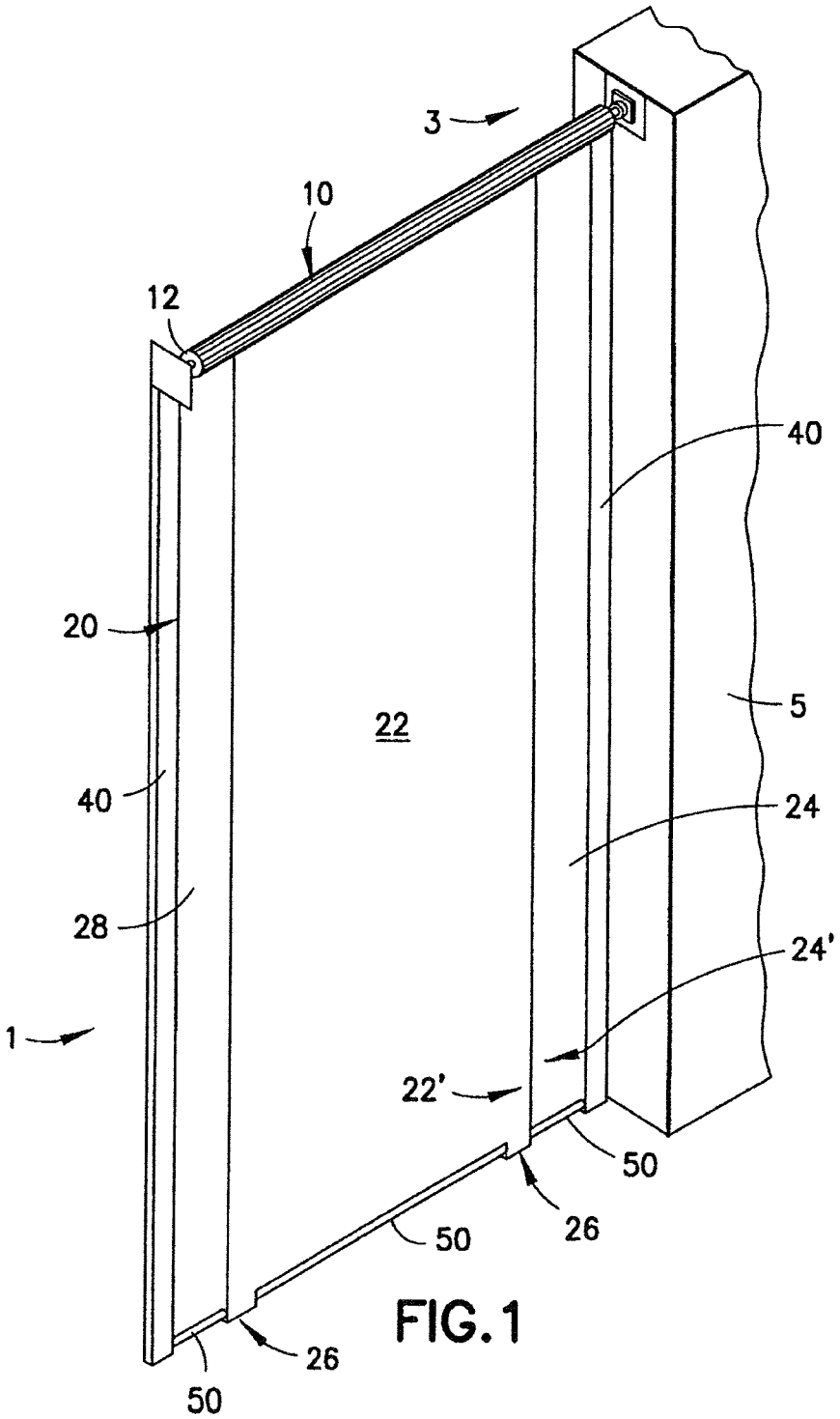
FIG. 1 is a perspective view of a fire door assembly formed according to an embodiment of the invention.

In the various embodiments described below and depicted in the drawing figures, the fire and/or smoke blocking device is in the form of a fire door assembly and is a labeled fire door assembly. The fire and/or smoke blocking device can also be formed as a fire curtain assembly, a smoke door assembly, a smoke curtain assembly, or similar assemblies that are labeled assemblies and can be used in a fire and/or smoke situation to cover a structure opening, so as to prevent fire and/or smoke from spreading to other sections of the structure.

FIGS. 1 to 4 show a fire door assembly 1 formed according to a first embodiment of the invention. For the convenience of description, the fire door assembly 1 is shown and described in connection with a structure opening 3 in a lateral wall of a structure 5, and can be used in connection with structure openings otherwise oriented. In FIG. 1, the fire door assembly 1 is shown in an extended position for covering a structure opening 3 in a sidewall of the structure 5. The fire door assembly 1 comprises a retracting assembly 10 including a roller assembly 12 rotatably mounted to a structure 5 by various known methods. For example, the roller assembly 12 can be horizontally arranged and mounted to a structure portion positioned proximate the upper end of a structure opening 3.

Wrapped about the roller assembly 12 is a curtain panel 20, which can be any suitable rolling door configuration possessing the desired characteristics of flexibility, durability, and fireproof. For example, the curtain panel 20 can be made to be flexible and of a suitable textile material, textile composite material, or metallic material. When the flexible curtain panel 20 is in its extended position as shown in FIG. 1, a fire barrier is established across the structure opening 3. Emergency egress or ingress is formed in the curtain panel 20 as will be described in greater detail below.

One advantage of a roll-type door structure is derived from its minimal space requirements and out-of-the way placement above a structure opening 3 when in a retracted position. When not needed, the flexible curtain panel 20 may be wound onto the roller assembly 12 and maintained in a retracted position. The flexible curtain panel 20 may also, in accordance with an operating sequence to be described in detail later, be unwound by various known methods, including conventional hand crank or power drive means, into the extended position shown in FIG. 1. It should be noted that power drive means is not considered a novel aspect of the present invention and that any suitable means may be employed to rotate the roller assembly 12 to thereby cause extension or retraction of flexible curtain panel 20. Because suitable mechanisms for this purpose are known in the art, a detailed description of the same has been deemed unnecessary and therefore omitted for clarity.

Figure 2:
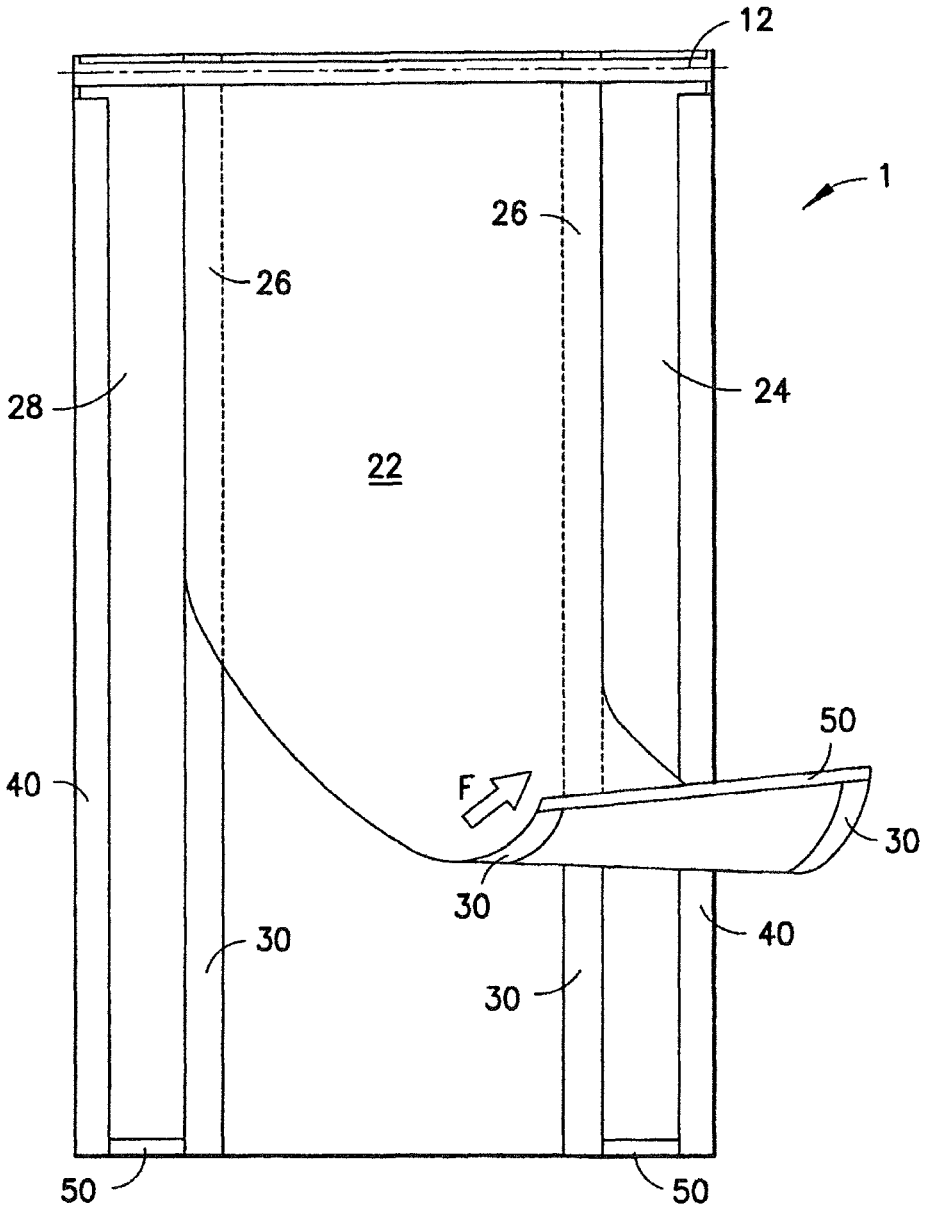
FIG. 2 is an elevation view of a fire door assembly with the center panel partially separated from the side panels to reveal the fasteners.

The curtain panel 20 can comprise first and second panel portions 22, 24. In the example shown in FIG. 1, the first panel portion 22 is arranged in a center portion along the transverse width of the curtain panel 20. The second panel portion 24 is arranged on one side of the first panel 22. The first and second panel portions 22, 24 can have mutually opposite edge portions 22', 24' that are releasably connectable to form a blocking condition, as is shown in FIG. 1, where the fire door assembly 1 acts as a barrier to prevent fire and/or smoke from spreading from one side of the fire door assembly 1 to the other side. For example, the opposite edge portions 22', 24' can connect to each other in an end-to-end fashion. In the examples shown in FIGS. 2 to 4, the first panel portion 22 can at least partially overlap with the second panel portion 22 to form an overlapping region 26. As FIG. 2 shows, the overlapping region 26 has an elongated shape extending throughout the entire length of the curtain panel 20. One skilled in the art will appreciate that various methods can be employed to form such an overlapping region 26.

A third panel portion 28 can also be provided on an opposite side edge of the first panel portion 22 and separated from the second panel portion 24 by the first panel portion 22. The third panel portion 28 can be similarly formed to the second panel portion 24 and at least partially overlap with the first panel portion 22 to form another overlapping region 26, as further illustrated in FIGS. 3 and 4. All the first, second, and third panel portions 22, 24, 28 can be wound onto the roller assembly 12 when the fire door assembly 1 is in the retracted position or unwound from the roller assembly 12 to form a fully extended curtain panel 22 at the extended position.

Figure 3:
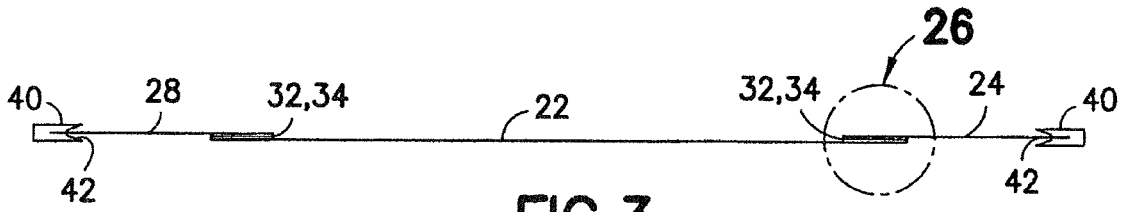
FIG. 3 is a top view of the fire door assembly shown in FIG. 2.
Figure 4:
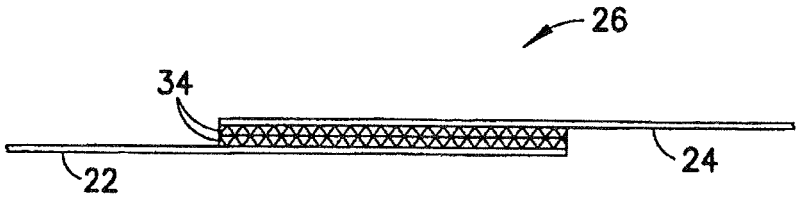
FIG. 4 is an enlarged view of portion D shown in FIG. 3.

As is illustrated in FIGS. 2 to 4, a fastener 30 is provided on and fixed to each of the panel portions 22, 24, 28 to releasably connect the panel portions 22, 24, 28 to each other forming a blocking condition. For example, a fastener 30 is fixed to each of the mutually opposite edge portions 22', 24' of the first and second panel portions 22, 24 by various known methods. As FIGS. 2 to 4 show, the fastener 30 can be positioned in the overlapping regions 26. In one example, the fastener 30 is formed to have an elongated shape, similar to that of the overlapping region 26 and fixed to the overlapping edge portions 22', 24' of the first and second panel portions 22, 24 so that the first and second panel portions 22, 24 are continuously fastened from the top to the bottom of the edge portions 22', 24'.

Various other releasable type fasteners can be used as the fastener 30. For example, the fastener 30 can comprise strips 32 of magnetic materials attracted to each other or metal and magnetic materials. In an alternative example, the fastener 30 can comprise hook and loop fasteners 34, which are formed on the first and second portions 22, 24 in their overlapping regions 26.

The fastener 30 is designed so that it can repeatedly alternate between an engaged condition and a disengaged condition, to thereby releasably attach the panel portions 22, 24 and/or 22, 28. For example, the fastener 30 attaches the overlapping first and second panel portions 22, 24 to each other in an engaged condition and form a blocking condition. When an egress force F is exerted on the first panel portion 22 in an egress direction, the fastener 30 is disengaged so that the first and second panel portions 22, 24 can be separated from each other to form an egress E through the curtain panel 20. Upon relaxation or removal of the egress force F, the first and second panel portions 22, 24 can return to the closed position, as is shown in FIG. 1, and be rejoined to each other by the fastener 30 to close the egress E. It will be appreciated that the fire door assembly 1 may meet the appropriate level of fire and/or smoke protection once the first panel portion 22 returns to the closed position, with or without being reengaged with the second panel portion 24 by the fastener 30 depending on the applicable code or standard. For example, the mutually opposite edge portions 22', 24' of the first and second panel portions 22, 24 can overlap with or abut each other to cover the structure opening 3.

The fire door assembly 1 can also include first and second side frames 40, which are to be mounted to the structure 5. The side frames 40 each define a recess 42 (FIG. 3) therein for receiving and guiding a corresponding side edge of the curtain panel 20. Such side frames 40 can provide additional stability for the flexible curtain panel 20 as the curtain panel 20 is moved between its retracted position and extended position. Additionally or alternatively, the side frames 40 can hold the side edge of the curtain panel 20 in position when the curtain panel 20 is in the extended position.

In an example shown in FIG. 1, a closure device 50 is provided and formed on the curtain panel 20 along a curtain edge opposite to the roller assembly 12, e.g., the bottom edge of the curtain panel 20. In one example, the closure device 50 is operable to conform to the condition of the structure surface that the closure device 50 is disposed on when the fire door assembly 1 is in an extended position. For example, the closure device 50 can be in the form of a flexible pocket 52 formed along the bottom edge of the first panel portion 22 and contain a conformable material in the pocket 52. Additionally or alternatively, an additional closure device 50 can be similarly formed on the second and/or third panel portions 24, 28 of the curtain panel 20.

The pocket 52 can be formed in various manners. For example, the pocket 52 can be formed from the same material piece used to form the corresponding panel portions 22, 24, 28, such as by folding over an end portion of the material piece and affix the free end to the overlapping material piece. The pocket 52 can also be separately formed, with or without the conformable material, and then fixed to the panel portions 22, 24, 28. The conformable material can be any material that has a sufficient mass and can freely move or flow when not being restricted. Preferably, the conformable material is a material with a higher density than the curtain panel material. For example, sand or water can be used in the pocket 52 as a conformable material.

Because of the mobility and heavier weight of the conformable material inside the pocket 52, the closure device 50 is operable to conform to any irregularity on the floor surface of the structure 5, thereby fully covering and/or sealing the structure opening 3 when the curtain panel 20 is in the extended position. Additionally or alternatively, the closure device 50 can operate to assist the first panel portion 22 to return to the closed position due to the added weight at the bottom of the first panel portion 22.

Figure 5:
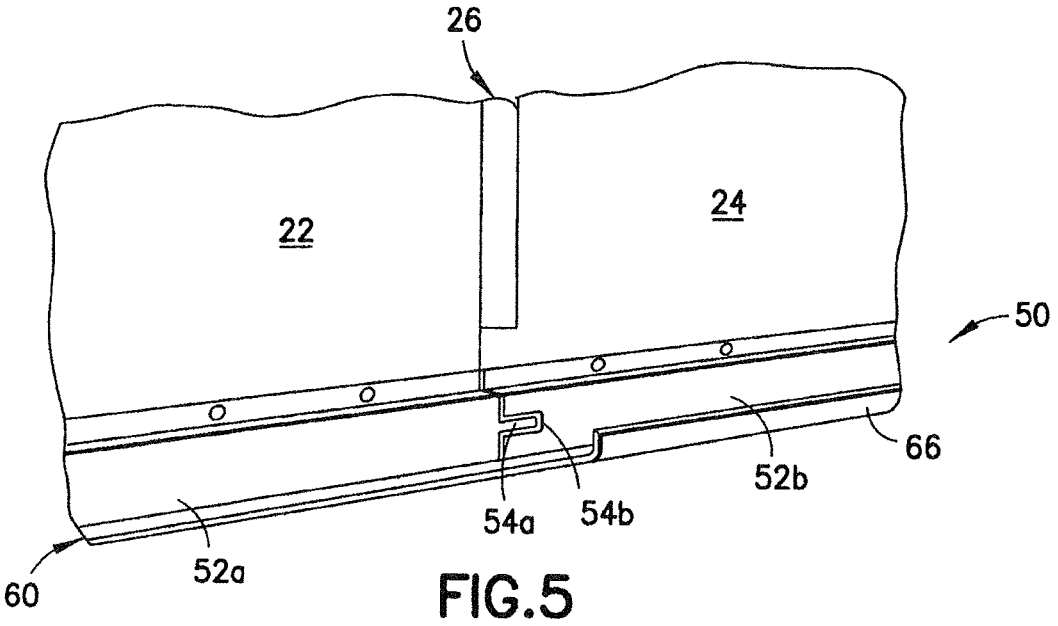
FIG. 5 is a partial perspective view from an egress side of a fire door assembly showing the closure device when the first panel portion is in a blocking condition.
Figure 6:
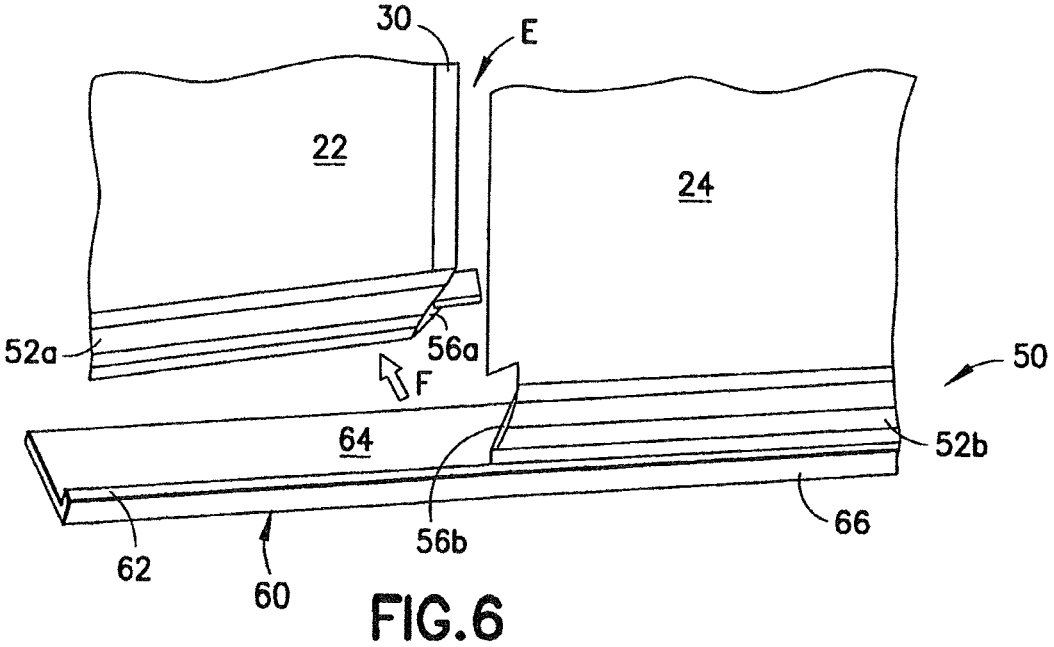
FIG. 6 is a partial perspective view of the fire door assembly of FIG. 5 from the opposite egress side showing the closure device when the first panel portion is in an open position.

In additional examples shown in FIGS. 5 and 6, the closure device 50 can be in the form of metal rails 52*a*, 52*b* fixed to the bottom edges of the first and second panel portions 22, 24. The metal rails 52*a*, 52*b* can be formed so that they conform to the floor surface when the fire door assembly 1 is in the extended position. For example, the metal rails 52*a*, 52*b* are formed so that they are flat at the bottom to conform to a flat floor surface.

Optionally, the metal rails 52*a*, 52*b* can be formed with one or more interlocking portions 54*a*, 54*b* to facilitate in retaining the first panel portion 22 in the closed position. For example, the interlocking portions 54*a*, 54*b* can be formed as male and female interlocking portions. Once the interlocking portions 54*a*, 54*b* are engaged with each other, they can operate to prevent the first panel portion 22 from moving in a vertical direction in relation to the second panel portion 24. The interlocking portions 54*a*, 54*b* are formed on the egress side of the fire door assembly 1, allowing the first panel portion 22 to be deflected in response to an egress force F (FIG. 6) and, when the first panel portion 22 returns to the closed position, preventing the first panel portion 22 from moving away from the closed position.

Additionally or alternatively, the metal rails 52*a*, 52*b* can be formed with one or more guiding portions 56*a*, 56*b* to facilitate the first panel portion 22 in returning to the closed position. The guiding portions 56*a*, 56*b* can be formed as slanted ends of the metal rails 52*a*, 52*b* opposing to each other in a closed position. Upon relaxation or removal of the egress force F, the guiding portions 56*a*, 56*b* can aid the first panel portion 22 to return to the closed position.

As is shown in FIGS. 5 and 6, the fire door assembly 1 can have a bottom frame 60 provided and configured to be mounted to the structure 5. The bottom frame 60 can cooperate with the closure device 50 and facilitate retention of the same in position when the fire door assembly 1 is in the extended position when used in an emergency situation. The bottom frame 60, for example, comprises a first curtain stop 62 for restricting the first panel portion 22 from moving away from a closed position when returning to such closed position (FIG. 1) from the egress condition (FIG. 2). In one example, the first curtain stop 62 is in the form of a rib raised from a supporting plate 64 on the egress side, as is shown in FIG. 6. In this example, the supporting plate 64 can be substantially flat to conform to the metal rails 52*a*, 52*b*.

Additionally or alternative, the bottom frame 60 can comprise a second curtain stop 66 for restricting the second panel portion 24 from lateral movement in relation to the structure. In the examples shown in FIGS. 5 and 6, the second curtain stop 66 is in the form of a pair of ribs raised from the supporting plate 64 and spaced from each other for retaining at least a portion the closure device 50, such as the metal rail 52*b*, therein.

In operation, the fire door assembly 1 is installed in a structure opening 3 and maintained in a retracted position. During an emergency, the fire door assembly 1 will turn into the extended position in a known manner, whereby the panel portions 22, 24, 28 will unwind from the roller assembly 12 and become extended as are shown in FIG. 1. The closure devices 50 formed at the bottom edges of the panel portions 22, 24, 28 can assist the panel portions to become fully extended to cover the structure opening 3 to prevent fire or smoke from spreading from one side of the curtain panel 20 to the other side thereof. The closure devices 40 can also fit into the bottom frame 60 to be maintained in the blocking condition in the event of pressure change due the fire and/or smoke condition.

When egress is needed, the user may pull or push the first panel portion 22 to disengage the fastener 30 from its engaged position and move away from the blocking position to form an egress through the curtain panel 20. Once the user passes through the egress to the safe side, the user can simply release the first panel portion 22. The first panel portion 22 will return to its blocking position under the action of gravity from the mass of the first panel portion 22, as well as the closure device 50 attached to the bottom of the first panel portion 22 if such closure device 50 is employed. When the first panel portion 22 returns to its blocking position and overlaps with the second panel portion 24, the fastener 30 operates to reengage and secure the first and second panel portions 22, 24 to each other so as to retain the blocking condition and prevent fire and smoke from spreading through the egress.

Figure 7:
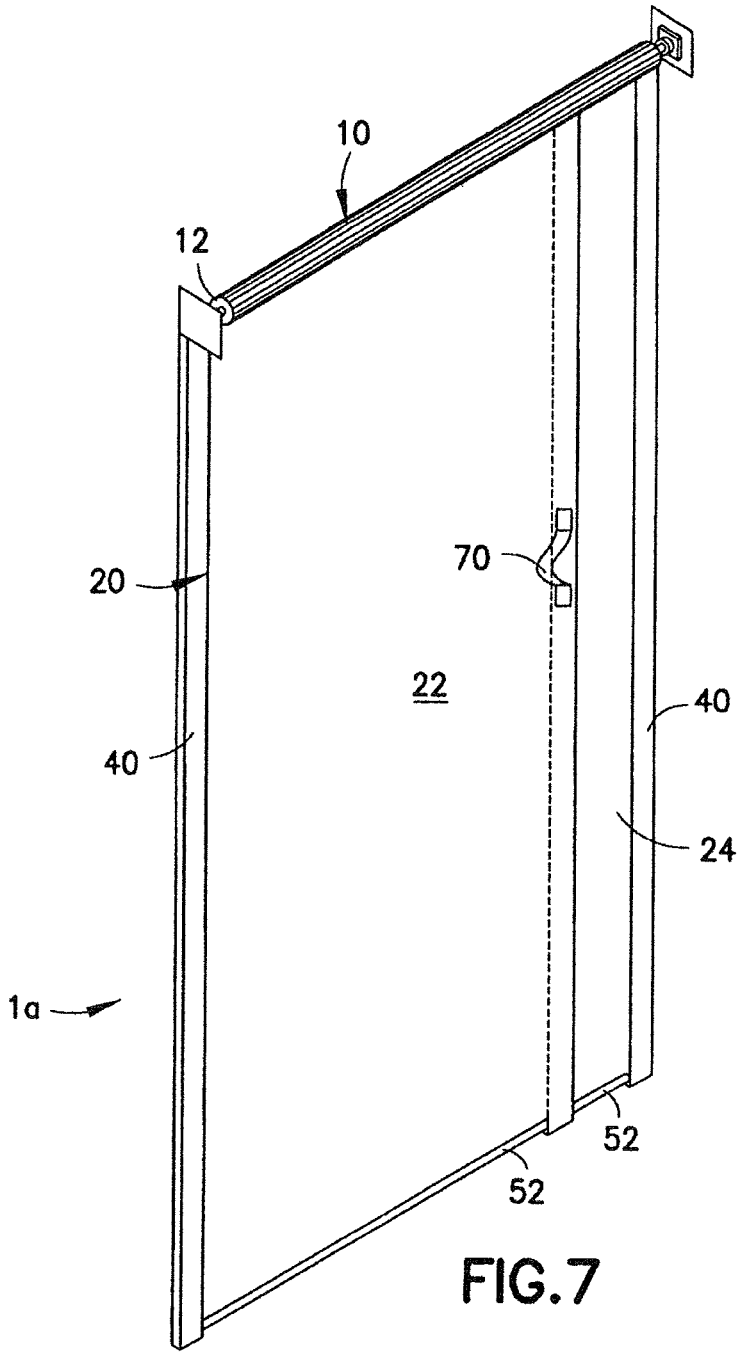
FIG. 7 is a perspective view of a fire door assembly formed according to another embodiment of the invention.

FIG. 7 shows a fire door assembly 1*a* formed according to a second embodiment of the invention, which is similar to the fire door assembly 1 shown in FIGS. 1 to 4. In this embodiment, only one first panel portion 22 and one second panel portion 24 are provided forming a single overlap region 26, and in turn one egress for passing through the curtain panel 20. The single egress structure shown in FIG. 7 can be beneficial in returning the first panel portion 22 to the overlapping condition, after being deflected therefrom to form the egress, so as to be re-secured to the second panel portion 24 through the fastener 30.

Optionally, a collapsible handle 70 can be provided on the first panel portion 22. For example, the collapsible handle 70 can be provided on the pulling side of the first panel portion 22 to assist in separating the first panel portion 22 from the second panel portion 24 when forming the egress. In FIG. 7, the first panel portion 22 is shown to be pulled toward the reader when the first panel portion 22 is detached from the second portion 24 to form the egress. The handle 70 can assist the user in operating the fire door assembly 1*a*. The 70 handle can be formed in a collapsible manner so that it can be wound onto the roller assembly 12 along with the curtain panel 20.

Figure 8:
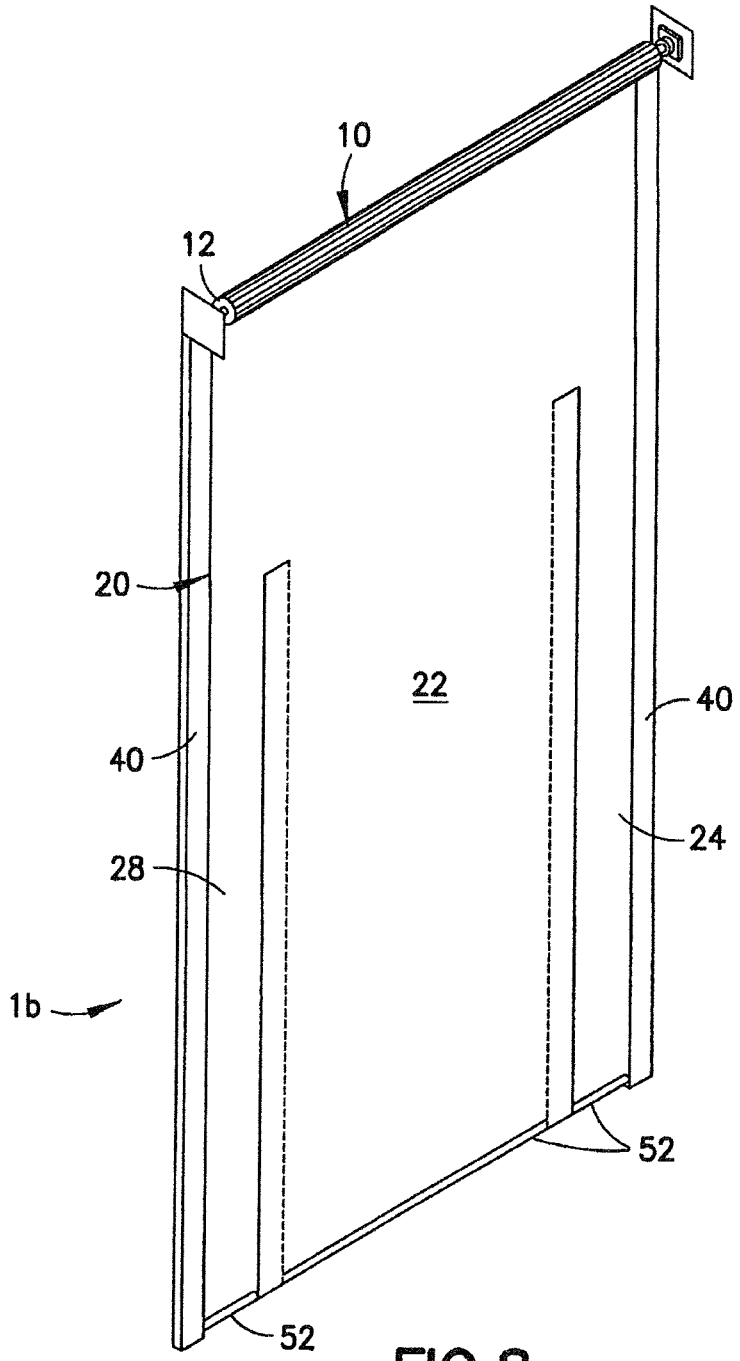
FIG. 8 is a perspective view of a fire door assembly formed according to another embodiment of the invention.

FIG. 8 shows a fire door assembly 1*b* formed according to a third embodiment of the invention, in which the overlapping regions 26 extend along only a portion of the entire length of the curtain panel 20. In particular, the top portion of the curtain panel 20 is free of the overlapping regions 26.

Figure 9:
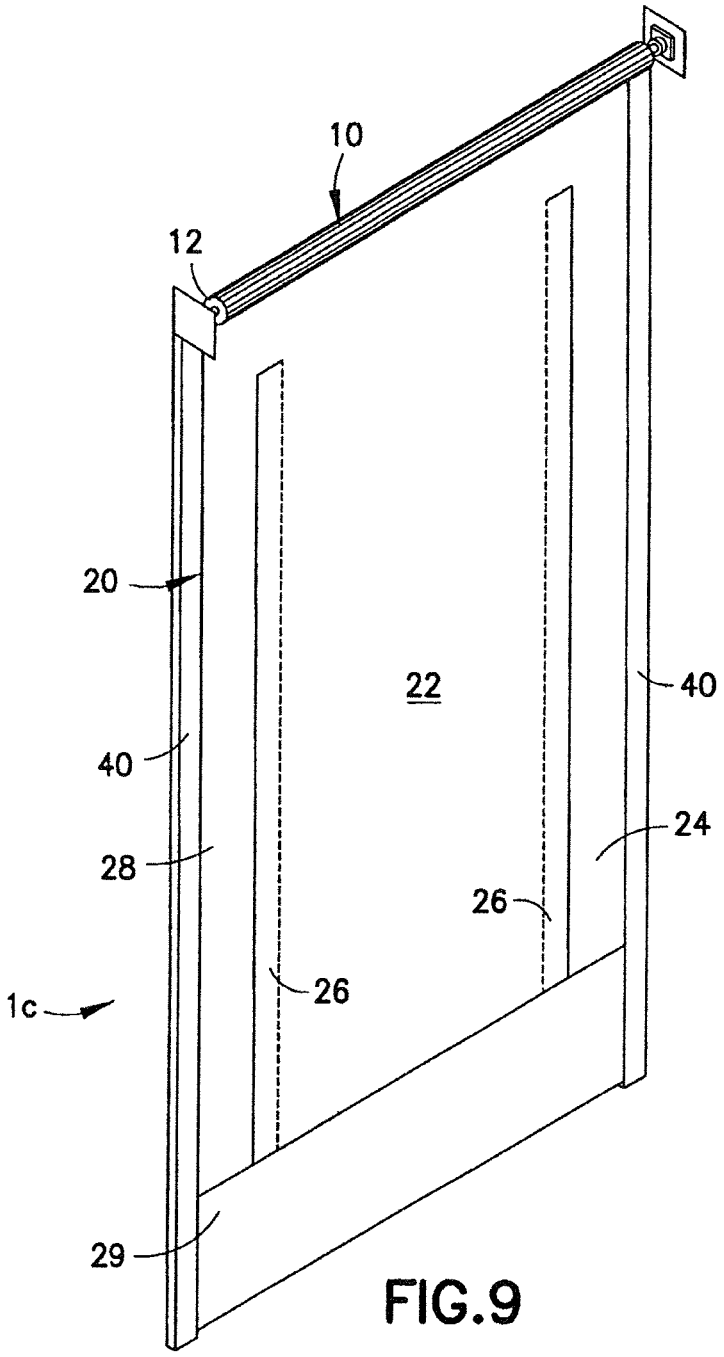
FIG. 9 is a perspective view of a fire door assembly formed according to another embodiment of the invention.

FIG. 9 shows a fire door assembly 1*c* formed according to a fourth embodiment of the invention, which is similarly formed to the fire door assembly 1*b* described above. In this embodiment, the overlapping regions 26 are formed in a middle section of the curtain length without extending into the top portion and the bottom portion of the curtain panel 20. As FIG. 9 shows, a reinforcement panel 29 is provided and attached to the bottom portion of the curtain panel 20. The closing panel 29 can operate to retain the first panel portion 22 in the closing condition and/or assist in returning the deflected first panel portion 22 to the overlapping condition.

Figure 10:
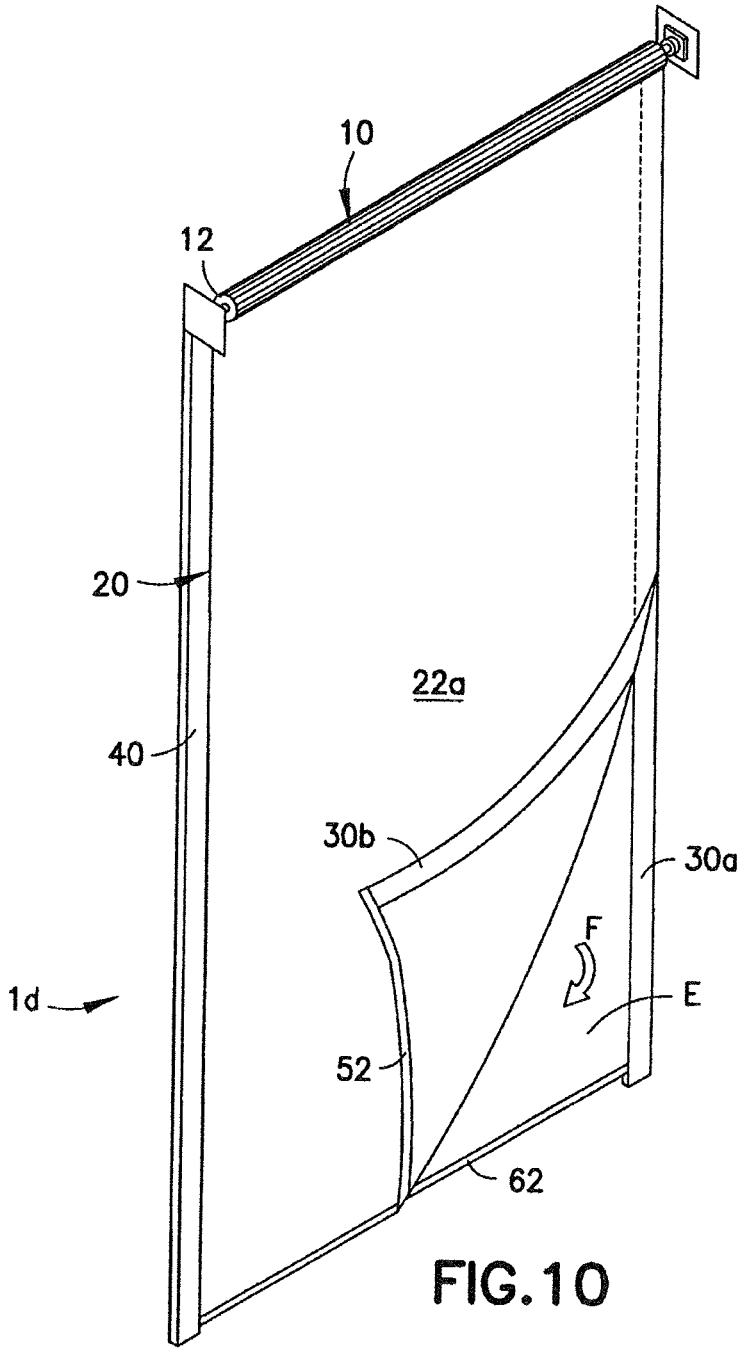
FIG. 10 is a perspective view of a fire door assembly formed according to another embodiment of the invention.

FIG. 10 shows a fire door assembly 1*d* formed according to a fifth embodiment of the invention. In this embodiment, the fire door assembly 1*d* comprises a movable flap 22*a*, which can be similarly formed as the first panel portion 22 and operably wound onto the roller assembly 12. In FIG. 10, a portion of the movable flap 22*a* is lifted open to show a first fastener 30*a* fixed to the right side edge of the movable flap 22*a*. The first fastener 30*a* is formed to engage a second fastener 30*b*, which is immovably mounted in relation to the structure 5. For example, FIG. 10 shows that the second fastener 30*b* is directly mounted on the sidewall of the structure 5. Such a second fastener 30*b* is supported to offset the roller assembly 12 so as to allow the movable flap 22*a* to unwind to its extended position without obstruction and to come in contact with the second fastener 30*b* to be attached thereto.

Alternatively, the second fastener 30*b* can be provided on a side panel portion, similar to the second panel portion 24 shown in FIGS. 1-4 or otherwise mounted to the structure 5. The first and second fasteners 30*a*, 30*b* are formed similarly to the fastener 30 described above.

When the movable flap 22*a* is unwound from the roller assembly 12 and extended to the extended position, the first and second fasteners 30*a*, 30*b* can releasably attach to each other to secure the movable flap 22*a* to the structure 5 and retain the blocking condition of the fire door assembly 1*d*. Similar to the fastener 30 described above, the first and second fasteners 30*a*, 30*b* in the embodiment can be selectively disengaged from each other in response to an egress force F to separate the moving flap 22*a* from the second fastener 30*b* and form an egress E therebetween. Once the egress force F is released, the movable flap 22*a* returns to the closed position due to the action of gravity. The first and second fasteners 30*a*, 30*b* can reengage with each other to close the egress.

The left side edge of the movable flap 22*a* can be secured to a side frame 40 in a similar manner that the third panel portion 28 is secured to a corresponding side frame 40 shown in FIG. 1. In the alternative, the left side edge of the movable flap 22*a* can be formed similarly to its right side edge and engage with a fastener immovably mounted on the right side in relation to the structure 5. In such a case, either side edge of the movable flap 22*a* can be detached and lifted to form an egress.

As one skilled in the art will appreciate, the fire door assembly 1, 1*a*, 1*b*, 1*c*, 1*d* described above can be applied to various structures. Although the above description is set forth in connection with a lateral sidewall of a structure 5, the various embodiments can also be used to horizontal walls of various structures. One or more of the above embodiments can be applied to cover any structural opening such as an elevator doorway or any other opening between two separate space.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An assembly for covering a structure opening in a structure wall, the assembly comprising:

a retracting member configured to be mounted to a portion of the structure wall defining the structure opening;

a curtain panel connected to the retracting member and being movable between a retracted position where the structure opening is at least partially uncovered and an extended position where the curtain panel covers the structure opening, the curtain panel comprising:

a first panel portion having a first vertical edge portion and a first extended position in which the first vertical edge portion is substantially fixed when the curtain panel is in the extended position;

a second panel portion having a second vertical edge portion and a second extended position when the curtain panel is in the extended position, the first and second vertical edge portions being mutually opposing when the first and second panel portions are in the first and second extended positions, the second vertical edge portion being moveable with respect to the first vertical edge portion;

a resealable fastener arranged along a length of the opposing first and second vertical edge portions of the first and second panel portions and configured to releasably attach the first panel portion and the second panel portion to each other along said length; and a closure device comprising a first rail formed on the first panel portion along a first edge of the first panel portion opposite to the retracting member, a second rail formed on the second panel portion along a second edge of the second panel portion opposite to the retracting member, and one of the first rail and the second rail includes a male portion protruding from an end portion of the one of the first rail and the second rail and the other of the first rail and the second rail includes an end portion defining a female portion comprising a recess to receive and confine the protruding male portion in an interlocking connection, to retain the second panel portion in a closed position attached to the first panel portion, wherein:

the fastener is configured to at least partially release the first and second panel portions from each other along said length, the male portion and the female portion are configured to separate, and a portion of the second panel portion is movable from the second extended position to a third position folded away from at least part of the first vertical edge portion in response to an egress force exerted on the second panel portion proximate said length to form an egress through the assembly, and upon relaxation or removal of the egress force, the second panel portion returns from the third folded away position to the second extended position, the fastener causes the first and second panel portions to reattach to each other along said length, and the male portion is received by the female portion to prevent fire and/or smoke from passing through the curtain panel.

2. The assembly of claim 1, wherein the first and second panel portions at least partially overlap with each other to form an overlapping region at least along the first and second vertical edge portions.

3. The assembly of claim 1, wherein the egress is formed within the curtain panel and the egress is surrounded by a curtain material.

4. The assembly of claim 1, wherein the curtain panel comprises a fireproof material.

5. The assembly of claim 1, wherein the fastener comprises strips of magnetic materials formed on the first and second vertical edge portions.

6. The assembly of claim 1, wherein the fastener comprises hook and loop fasteners formed on the first and second vertical edge portion.

7. The assembly of claim 1, wherein the closure device further comprises a pocket formed on the first panel portion and a conformable material contained in the pocket so that the closure device is conformable to a surface which the closure device abuts.

8. The assembly of claim 7, wherein the closure device further comprises an additional pocket formed on the second panel portion and a conformable material contained in the additional pocket so that the closure device is conformable to a surface which the closure device abuts.

9. The assembly of claim 1, further comprising a side frame configured to be mounted to the structure and retain one or more side edges of the curtain panel in position when the curtain panel is in the extended position.

10. The assembly of claim 1, further comprising:

a bottom frame including a curtain panel stop to substantially fix the first panel portion with respect to the bottom frame while in the first extended position.

11. The assembly of claim 10, wherein the curtain stop comprises a rib raised from the bottom frame at the egress side of the fire door assembly.

12. The assembly of claim 1, wherein:

the first rail and the second rail each have slanted ends in their end portions that oppose each other when the male portion is received by the female portion.

13. The assembly of claim 1, further comprising:

a horizontal panel attached to a bottom portion of the curtain panel.

14. The assembly of claim 10, wherein the bottom frame further comprises a second curtain panel stop for restricting the second panel portion from lateral movement in relation to the structure.

15. An assembly variable between an extended position for covering a structure opening and a retracted position to reveal the structure opening, the assembly comprising:

a retracting member configured to be mounted to a portion of the structure wall defining the structure opening;

a movable flap operably connected to the retracting member and covering at least a portion of the structure opening in a closed position, the moveable flap having a vertically arranged egress edge and a vertical fixed portion horizontally spaced from the vertically arranged egress edge;

a first fastener immovably mounted to the structure in the extended position, the first fastener extending along an entire length of the moveable flap in the extended position;

a second fastener fixed to the egress edge of the movable flap and operable to releasably attach to the first fastener to attach the movable flap to the structure in the closed position of the movable flap, the second fastener extending transversely to the retracting member in a direction of the extended position along the entire length of the moveable flap in the extended position; and a bottom frame comprising a continuous raised rib that restricts the movable flap from lateral movement in relation to the structure when the movable flap returns to the closed position, the raised rib being on an egress side of the bottom frame, the raised rib being stationary with respect to the bottom frame, wherein:

the first and second fasteners separate and the movable flap folds away from the closed position in response to an egress force exerted on the movable flap proximate said length to form an egress through the assembly, the movable flap is operable to return to the closed position to close the egress upon removal or relaxation of the egress force, under a force of gravity, and the first and second fasteners attach to each other when the moveable flap returns to the closed position.

16. The assembly of claim 15, further comprising a side panel immovably mounted in relation to the structure when the curtain panel is in the extended position, wherein the first fastener is mounted to the side panel.

17. The assembly of claim 16, wherein the retracting member comprises a roller assembly and the side panel is operably wound onto the roller assembly together with the movable flap when the assembly is in the retracted position.

18. The assembly of claim 16, further comprising a frame mounted to the structure, wherein the side panel is at least partially retained in the frame when the assembly is in the extended position.

19. The assembly of claim 15, wherein the first and second fasteners engage with each other in the closed position.

* * * * *